US012534328B2

(12) United States Patent
Elliott

(10) Patent No.: US 12,534,328 B2
(45) Date of Patent: Jan. 27, 2026

(54) ELASTIC HAIR TIE DISPENSER

(71) Applicant: TIY Products, LLC, Austin, TX (US)

(72) Inventor: Jerritt K. Elliott, Austin, TX (US)

(73) Assignee: TIY Products, LLC, Austin, TX (US)

( * ) Notice: Subject to any disclaimer, the term of this patent is extended or adjusted under 35 U.S.C. 154(b) by 711 days.

(21) Appl. No.: 17/539,013

(22) Filed: Nov. 30, 2021

(65) Prior Publication Data

US 2023/0166937 A1 Jun. 1, 2023

Related U.S. Application Data

(63) Continuation of application No. 17/118,531, filed on Dec. 10, 2020, now abandoned, which is a continuation of application No. 16/790,653, filed on Feb. 13, 2020, now abandoned, which is a continuation of application No. 16/000,827, filed on Jun. 5, 2018, now Pat. No. 10,597,250.

(60) Provisional application No. 62/516,464, filed on Jun. 7, 2017.

(51) Int. Cl.

| | |
|---|---|
| ***B65H 35/00*** | (2006.01) |
| ***A45D 8/34*** | (2006.01) |
| ***A45D 44/00*** | (2006.01) |
| ***B65H 51/32*** | (2006.01) |

(52) U.S. Cl.

CPC ..... *B65H 35/002* (2013.01); *A45D 44/00* (2013.01); *B65H 35/0086* (2013.01); *B65H 51/32* (2013.01); *A45D 8/34* (2013.01); *B65H 2407/10* (2013.01)

(58) Field of Classification Search

CPC ..... B65H 35/002; B65H 35/0086; B65H 2407/10; B65H 51/32; A45D 44/00; A45D 8/34

USPC ..... 221/275

See application file for complete search history.

(56) References Cited

U.S. PATENT DOCUMENTS

| | | | | |
|---|---|---|---|---|
| 2,452,584 A | | 11/1948 | Luebkeman | |
| 2,582,979 A | * | 1/1952 | Fritzinger | B65H 35/0033 83/252 |
| 2,604,166 A | | 7/1952 | Turner | |

(Continued)

FOREIGN PATENT DOCUMENTS

| | | | | |
|---|---|---|---|---|
| GB | 2231553 A | * | 11/1990 | B65H 35/0033 |
| JP | H0831145 A | * | 2/1996 | G11B 23/38 |

OTHER PUBLICATIONS

Tactical Rope Dispenser—TRD by Atwood Rope MFG; Oct. 19, 2016; retrieved from https://www.youtube.com/watch?v=KVvg1ev-5Tw on Aug. 2, 2018.

*Primary Examiner* — Rakesh Kumar

(74) *Attorney, Agent, or Firm* — Jackson Walker L.L.P.

(57) ABSTRACT

The present invention provides an elastic hair tie material and an elastic hair tie dispenser for dispensing varying lengths of elastic hair tie material. More particularly, the present Elastic Hair Tie Dispenser device has been configured with a flexible cover, a pivoting cutting blade actuator and cutting blade to conveniently dispense elastic hair tie material of varying color, cut to any desired length by the user of the dispenser, to be worn by women or men to restrain their hair in many varying different stylish configurations and for varying purposes, and wherein the dispenser is refillable by either winding hair tie material onto a spool rotatably housed within the dispenser or inserting a new coil of hair tie material sold separately.

18 Claims, 7 Drawing Sheets

(56) References Cited

U.S. PATENT DOCUMENTS 2,759,545 A * 8/1956 Rizza ..... B65H 35/008 225/45
3,246,815 A * 4/1966 Philip ..... A61C 15/043 225/80
3,525,462 A * 8/1970 Freedman ..... A61C 15/043 225/21
3,746,225 A * 7/1973 Runckel ..... A61C 15/043 225/56
3,832,841 A 9/1974 Cole
3,895,059 A * 7/1975 Link ..... B65H 35/0033 156/577
4,111,089 A * 9/1978 Montaruli ..... B65H 49/205 225/45
4,196,647 A * 4/1980 Fish ..... B65D 85/672 83/610
4,244,254 A * 1/1981 Fish ..... B26D 1/345 206/407
4,354,619 A * 10/1982 Wippermann ..... B65D 83/0409 221/289
4,637,516 A * 1/1987 de Roure ..... B65D 75/305 53/409
4,915,320 A 4/1990 Neal
5,080,270 A 1/1992 Kai
5,133,980 A 7/1992 Ream et al.
5,172,841 A 12/1992 Friedman
5,189,453 A * 2/1993 Boyd ..... G03B 15/08 396/387
5,280,741 A 1/1994 Bell et al.
5,456,274 A 10/1995 Selbee et al.
5,524,843 A 6/1996 McCauley
5,582,041 A 12/1996 Spiess
6,047,708 A 4/2000 Panel et al.
6,095,323 A 8/2000 Ferguson
6,161,288 A 12/2000 Andrews
6,182,672 B1 2/2001 Abasta-Douglas et al.
6,386,416 B1 * 5/2002 Dunshee ..... B65H 37/005 225/53
6,398,093 B1 * 6/2002 Dolan ..... A61C 15/043 225/41
6,457,665 B1 10/2002 Koehler et al.
6,557,262 B1 5/2003 Clemence et al.
6,616,360 B2 9/2003 Lehmkuhl
6,694,667 B2 2/2004 Davis
7,305,996 B2 12/2007 Kraft et al.
7,641,087 B2 1/2010 Chang
7,908,953 B2 * 3/2011 Yarborough ..... B65H 49/08 83/649
8,047,461 B1 11/2011 Slawson
8,083,114 B1 12/2011 Steele et al.
8,602,280 B2 12/2013 Chang
9,032,629 B2 5/2015 Bermes et al.
9,266,698 B2 * 2/2016 Sheehy ..... B65H 49/205
10,099,394 B2 10/2018 Bermes et al.
10,597,250 B2 * 3/2020 Elliott ..... A45D 44/02
2006/0118589 A1 6/2006 Arnarp et al.
2008/0105723 A1 5/2008 Chang
2009/0032197 A1 * 2/2009 Harman, Jr. ..... E04F 21/026 156/575
2009/0178690 A1 7/2009 Olsen
2011/0048450 A1 3/2011 Tsai
2012/0035760 A1 * 2/2012 Portney ..... G16H 20/13 700/231
2013/0263884 A1 10/2013 Hogan et al.
2015/0164195 A1 * 6/2015 Elliott ..... A44C 5/0069 132/273
2018/0000204 A1 1/2018 Ingimundarson et al.
2018/0305163 A1 10/2018 Nicolle
2019/0389681 A1 12/2019 Miller, II
2023/0166937 A1 * 6/2023 Elliott ..... A45D 44/00 221/185

* cited by examiner

ELASTIC HAIR TIE DISPENSER

CROSS-REFERENCE TO RELATED APPLICATIONS

The present application is a continuation of U.S. patent application Ser. No. 17/118,531, filed Dec. 10, 2020, which is a continuation of U.S. patent application Ser. No. 16/790,653, filed Feb. 13, 2020, now abandoned, which is a continuation of U.S. patent application Ser. No. 16/000,827, filed Jun. 5, 2018, now U.S. Pat. No. 10,597,250, which claims priority pursuant to 35 U.S.C. § 119 (e) to U.S. Provisional Application No. 62/516,464, filed Jun. 7, 2017, the disclosures of all of which are incorporated herein by reference in their entireties.

FIELD OF THE INVENTION

The present invention provides an elastic hair tie material and an elastic hair tie dispenser for dispensing varying lengths of elastic hair tie material. More particularly, the present Elastic Hair Tie Dispenser device has been configured with a flexible cover, a pivoting cutting blade actuator and cutting blade to conveniently dispense elastic hair tie material of varying color, cut to any desired length by the user of the dispenser, to be worn by women or men to restrain their hair in many varying different stylish configurations and for varying purposes, and wherein the dispenser is refillable by either winding hair tie material onto a spool rotatably housed within the dispenser or inserting a new coil of hair tie material sold separately.

BACKGROUND OF THE INVENTION

For many years the common rubber band has been the means for a person with long hair of holding it back in a ponytail away from their face. The problem with rubber bands is that they tend to break or damage the hair. Other items that are commonly used are scarfs and items that have been developed into a means of adornment like colorful fashion accessories. Presently more women as well as men have a need to hold their hair back to keep it out of their face. In many cases, there is an occupational necessity, such as in food servers, machine operators and athletes.

The elastic hair ties that can be found on the market today are very generic in their construction and design and do not effectively address the needs of the consumer. The majority of the designs on the market are a "one size fits all" product. Other companies have brought to the market elastic hair ties that are sized based on a criterion of age. Generally, they are made in adult or child's size. As a result, these products do not address the actual thickness of texture of an individual's hair. This does not allow the user to have a product that is more suited for their needs.

The products currently on the market are inexpensive and do not perform well or last very long due to basic problems with the quality of the material used in the construction. In order to keep prices low, the elastic material used is inferior and has a very short life span, both from retention of elasticity and breakage standpoint. A basic design flaw is a built-in weakness in the product where a metal "crimp" is used to attach two ends of the hair tie together that creates a point of failure when used repeatedly.

Numerous innovations for hair ties have been provided in the prior art that are described as follows. Even though these innovations may be suitable for the specific individual purposes to which they address, they differ from the present invention as hereinafter contrasted. The following is a summary of those prior art patents most relevant to the invention at hand, as well as a description outlining the difference between the features of the present invention and those of the prior art.

US Patent Application Publication No. US 2009/0178690 A1 of William John Olson is directed to a hair tie, having an elastic member extendable toward opposing ends and complementary fasteners located at least two portions of the elastic member. Optionally, the invention may include an ornament holder, having a fastener configured to removably attach to an elastic member.

This patent describes a hair tie only, having an elastic member extendable toward opposing ends and complementary fasteners but does not have the capabilities of dispensing varying color elastic hair tie material to be cut to different length for varying purposes of hair restraint and decoration.

US Patent Application Publication No. US 2013/0263884 of *Mariana* Hogan et al. describes a ponytail cover that includes an elastic band extending between first and second free ends. Fastening portions such as Velcro portions or hooks are positioned at the first and second free ends of the elastic band and can be fastened together so as to form the elastic band into a loop to cover a ponytail holder. Strips of hair extend over and substantially cover a surface of the elastic band that is outwardly facing when formed into the loop. A ponytail holder includes a band of hair extending between first and second free ends and hooks attached to the first and second free ends can be fastened together to secure the ponytail holder when the band of hair is wrapped around a ponytail.

This patent describes a ponytail cover that includes an elastic band but does not deal with the hair tie and does not have the capabilities of dispensing varying color elastic hair tie material to be cut to different length for varying purposes of hair restraint and decoration.

US Patent Application Publication No. US 2011/0048450 of Kai-Mou Tsia A hair binder for arranging the hair is disclosed to include an elastic cord member, a clamp affixed to the elastic cord member to join the ends of the elastic cord member, and a flexible protective sleeve covering the clamp and carrying a design.

This patent describes a hair binder for arranging the hair as a unique hair tie only, but does not have the capabilities of dispensing varying color elastic hair tie material to be cut to different length for varying purposes of hair restraint and decoration.

U.S. Pat. No. 7,305,996 of Sarah Kraft et al. describes an elastic band that includes an elongate elastic core, a sheath, and an elongate friction member. The elongate elastic core comprising a continuous loop and the sheath has an outer surface and surrounds the elongate elastic core. The elongate friction member is disposed in the sheath, such that at least a portion of the elongate friction member protrudes past the outer surface of the sheath.

This patent describes an elastic band that includes an elongate elastic core, a sheath, and an elongate friction member but does not have the capabilities of dispensing varying color elastic hair tie material to be cut to different length for varying purposes of hair restraint and decoration.

U.S. Pat. No. 6,182,672 of Feliz R. Abasta-Douglas et al. describes a looped fastener having a fabric covered elasticized member having a thin, substantially rectangular cross-sectional configuration having terminal ends formed in a loop by passing the elasticized member through a hollow open ended decorative body. The looped fastener is tightened and loosened by moving the open-ended body up and down the fabric covered elasticized member. The smaller the loop, the tighter the fasten. The larger the loop the looser the fasten. Secondary open-ended bodies affixed to the terminal ends of the fabric covered elasticized member prevent the elasticized member from accidentally being pulled out of the aforementioned open-ended body.

This patent describes a looped fastener having a fabric covered elasticized member having a thin, substantially rectangular cross-sectional configuration but does not have the capabilities of dispensing varying color elastic hair tic material to be cut to different length for varying purposes of hair restraint and decoration.

U.S. Pat. No. 6,047,708 of Sherelle I. Pannel et al. describes a hair bun kit and process which allows a hair bun to be easily and quickly formed. The hair bun kit consists of a first resilient hairband, a second resilient hairband and a hair bun mold having a centered opening, an upper surface and a lower surface. An optional ornamental hairband may also be included to enhance the aesthetics of the hair bun. To use the hair bun kit the first resilient hairband is tightly wrapped around a bundle of hair strands. The secured hair bundle is then inserted through the centered opening and the hair strands are draped over the upper surface of the mold. The second resilient hairband is placed over the draped hair strands and around the lower surface of the hair bun mold to secure the hair strands. The ornamental hairband is then placed around the lower surface of the hair bun mold to complete the hair bun.

This patent describes a hair bun kit and process which allows a hair bun to be easily and quickly formed but does not have the capabilities of dispensing varying color elastic hair tic material to be cut to different length for varying purposes of hair restraint and decoration.

U.S. Pat. No. 5,456,274 of Kathie Selbee et al. describes a removable cover for a hair band that has a fabric tube with first and second ends, the fabric tube having a longitudinally elasticized seam between the first and second ends whereby the cover is removably mountable on the hair band by sliding the fabric tube over the hair band so as to place the seam along an inside surface of the hair band.

This patent describes a removable cover for a hair band that has a fabric tube but does not have the capabilities of dispensing varying color elastic hair tie material to be cut to different length for varying purposes of hair restraint and decoration.

U.S. Pat. No. 3,832,841 of Bernard M. Cole describes an ornamental expansible strip for use as a yarn stretch gift packages tie and as a decorator hair tie, and the method of making the same. The expansible strip comprises an elastic core under a retained low stretch and an ornamental yarn cover embracing the same, the yarn cover comprising yarn strands which are stretched and coiled about in the same direction and on opposite side of the elastic core, the core and yarn cover combinedly possessing a stable twist, the yarn being tightly wound, and locked to the stretched and twisted elastic core.

This patent describes an ornamental expansible strip for use as a yarn stretch gift packages tie and as a decorator hair tie but does not have the capabilities of dispensing varying color elastic hair tie material to be cut to different length for varying purposes of hair restraint and decoration.

None of these previous efforts, however, provides the benefits attendant with the Elastic Hair Tie Dispenser.

The present application provides for an Elastic Hair Tie Dispenser and describes a new and unique means of dispensing replaceable elastic cording within a fabric sleeve, coming in a variety of different colors to be cut to any desired length for restraining the hair or used in a variety of different stylish hair configurations.

In this respect, before explaining at least one embodiment of the Elastic Hair Tie Dispenser in detail it is to be understood that the design is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

SUMMARY OF THE INVENTION

The principal advantage of the Elastic Hair Tie Dispenser is to readily dispense the unique replaceable elastic cording within a fabric sleeve, coming in a variety of different bright colors, and cut to any length desired by the user, for hair restraint.

Another advantage of the Elastic Hair Tie Dispenser is that it is small enough to be held in the palm of the hand.

Another advantage of the Elastic Hair Tie Dispenser is that it can cut the replaceable elastic cording to different lengths.

Another advantage of the Elastic Hair Tie Dispenser is that you can, by holding the device in the palm of the hand and pressing with the thumb cut the cording.

Another advantage of the Elastic Hair Tie Dispenser is that it is transparent, so the different colors of the elastic cording are visible.

Another advantage of the Elastic Hair Tie Dispenser is that it can be taken apart to refill, or to change the color of the elastic cording.

Another advantage of the Elastic Hair Tie Dispenser is that it can be sold as a sealed disposable unit or sold as a refillable unit.

These together with other advantages of the Elastic Hair Tie Dispenser, along with the various features of novelty which characterize the design, are pointed out with particularity in the claims annexed to and forming a part of this disclosure. For a better understanding of the Elastic Hair Tie Dispenser, its operating advantages and the specific advantages attained by its uses, reference should be made to the accompanying drawings and descriptive matter in which there are illustrated preferred embodiments of the Elastic Hair Tie Dispenser.

The preferred embodiment of this Elastic Hair Tie Dispenser will be a small round flat device that can easily fit into the palm of one hand and will cut the replaceable elastic cording within a fabric sleeve by pressing the pivoting blade actuator with the thumb cutting it to any desired length. The device consists of a right hand and left hand transparent sections that can be attached by the means of screws, fasteners or permanently attached so that it will not be refillable, but rather sold as a disposable unit. By being transparent, the dispenser unit shows the replaceable elastic cording within the attractive colors of fabric sleeve between the two halves of the device. The elastic cording will be available in a round or square shape and a wide variety of bright colors.

The elastic cording is cut by the means of a blade attached to the pivoting blade actuator that automatically retracts after cutting the elastic cording. When finger guides on both sides of the two halves of the transparent sections moves within the cavities between the two spring back fingers of the pivoting blade actuator, it rotates on bosses that are on the outside of the transparent sections. A polyurethane cutting pad is sealed within the right hand and left hand transparent sections to cushion the blade edge. A flexible cover exposes the pivoting blade actuator and protects the person using the device from being cut by the cutting blade.

In one aspect, a disclosed elastic hair tie dispenser includes two round transparent clamshell housing sections configured to be held together with fasteners. When assembled, the two housing sections form a dispenser housing configured to accept a centrally located spool and a cutting blade. An elastic hair tic cording material of the hair tie dispenser may be removably wound around the spool forming a coil within the assembled dispenser housing. A cording orifice and a cutting slot may be molded into the dispenser housing. A pivoting blade actuator assembly may be movably attached to the dispenser housing. The pivoting blade actuator assembly may include a cutting blade therein. The clastic hair tie cording spooled within the housing may be dispensed by being pulled through the cording orifice to a variable desired length then cut with the pivoting blade actuator cutting blade. The spool may include a hair tie material fastening slot and an external slot, wherein the hair tie material coiled within the housing is fastened to the spool, and a user can coil hair tie material back into the dispenser housing by winding the hair tie material using a screwdriver positioned within the external slot, thereby obtaining any desired length of hair tie material to be cut and subsequently used.

The elastic hair tie cording material may include an elastomer core center which comprises 90% rubber compound, 5% color added and 5% solvents and releasing agents used in manufacture. The cording material may have an elasticity ratio of 4:1. The pivoting blade actuator assembly may include a blade attachment portion capable of accepting a removable replaceable cutting blade, spring back fingers, and an orifice for pivotably mounting on the dispenser housing. When in operation, the pivoting blade actuator assembly may be forced forward by a user, the cutting blade cuts the elastic hair tie cording material dispensed into any desired length by a user, and springs back to be in position to cut again. The elastic hair tie cording material may be sold separately as an individual coil package and can be inserted into the dispenser housing by disassembling the housing, thereby refilling the dispenser housing with a coil of elastic hair tie cording material. The elastomer core center may be covered by fabric of varying colors.

The dispenser housing may include a cutting pad accepting section wherein a cutting pad is mounted and further wherein when the cutting blade is actuated using the pivoting blade actuator assembly, the cutting blade moves to cut the hair tie material and stops on the cutting pad working as a cushion for the cutting blade. The elastic hair tie dispenser according to claim 1, includes a removeable pivoting blade assembly safety cover wherein the safety cover attaches to the dispenser housing by snapping on to the dispenser housing and prevents the blade from unwanted exposure or actuation cutting motion when attached.

With respect to the above description then, it is to be realized that the optimum dimensional relationships for the parts of the Elastic Hair Tie Dispenser, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Elastic Hair Tie Dispenser. Further, since numerous modifications and changes will readily occur to those skilled in the art, it is not desired to limit the device to the exact construction and operation shown and described, and accordingly, all suitable modifications and equivalents may be resorted to, falling within the scope of the Elastic Hair Tie Dispenser application.

BRIEF DESCRIPTION OF THE DRAWINGS

The accompanying drawings, which are incorporated in and form a part of this specification, illustrate embodiments of the Elastic Hair Tie Dispenser and together with the description, serve to explain the principles of this device.

FIG. 2 depicts the replaceable elastic hair tie material comprising rubber cording within a fabric sleeve, coming in a variety of different colors, shown here packaged for sale and distribution in a zip lock plastic bag packaging, or the like.

As required, detailed embodiments of the present Elastic Hair Tie Dispenser are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present Elastic Hair Tie Dispenser in virtually any appropriately detailed structure.

DETAILED DESCRIPTION OF THE PREFERRED EMBODIMENTS

Figure 1:
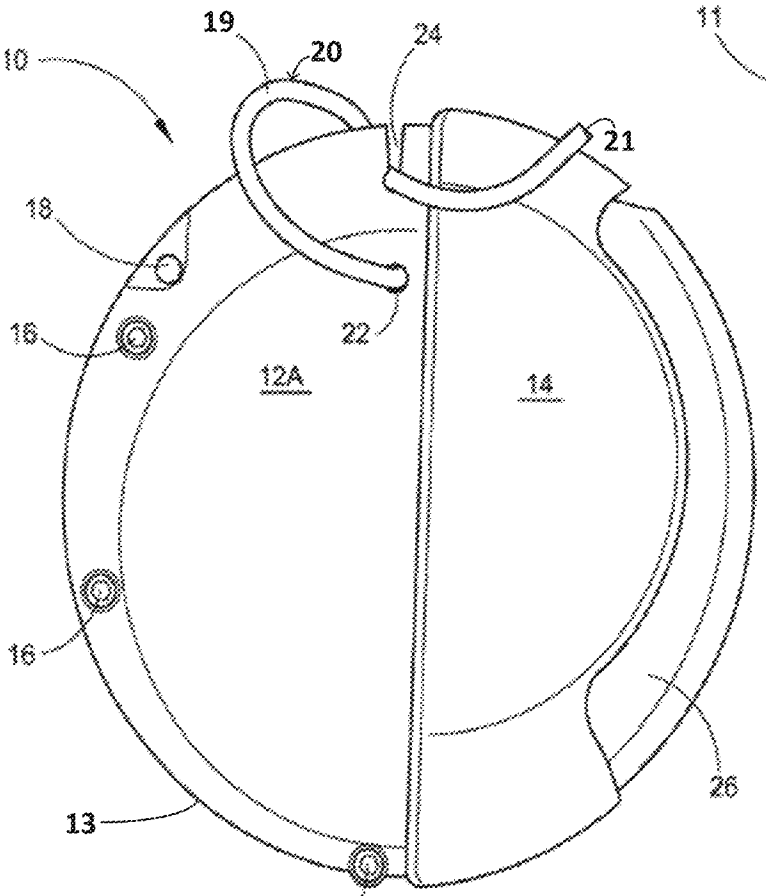
FIG. 1 depicts an assembled view of the Elastic Hair Tie Dispenser.

Referring now to the drawings, wherein similar parts of the Elastic Hair Tie Dispenser 10 are identified by like reference numerals, there is seen in FIG. 1 an assembled view of the Elastic Hair Tie Dispenser 10, including the left side transparent housing section 12A, of a dispenser housing 13, being held together with screws 16. A lanyard orifice 18 is on the edge of the device with the replaceable elastic cording 20 within a fabric sleeve 19 coming out of cording orifice 22 and wrapped around through the cutting slot 24. The flexible safety cover 14 houses the pivoting blade actuator 26.

Figure 2:
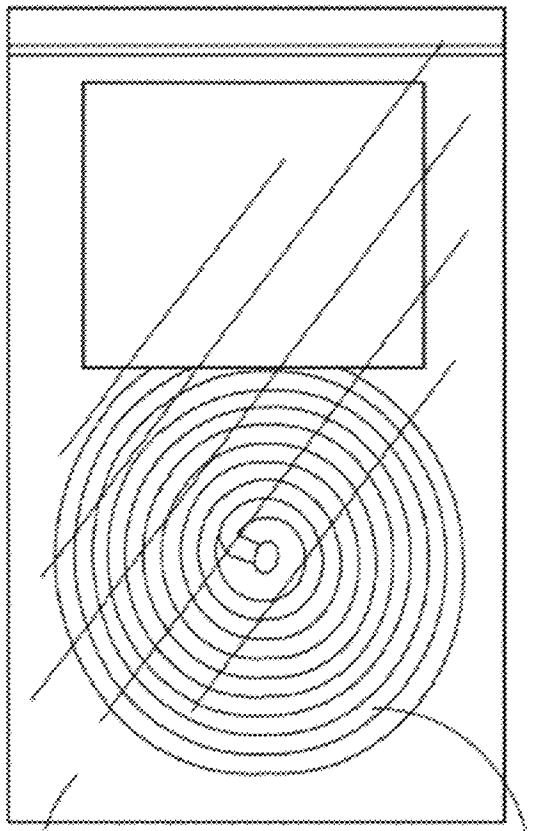

FIG. 2 depicts one type of retail packaging option 11 including the replaceable elastic cording 20 within a fabric sleeve, coming in a variety of different colors in a zip lock plastic bag 28, packaging or the like. The elastic hair tie material is constructed of an elastomer core center 21 (FIG. 1) which comprises 90% rubber compound, 5% color added and 5% solvents and releasing agents used in manufacture. Most typically, the rubber compound is 95% to 100% natural or synthetic rubber. The elastomer core center may also be manufactured in a variety of colors and shapes. The overall finished diameter of the product, sold in strands of varying lengths to be refillable into the Elastic Hair Tie Dispenser, is about 3 millimeters, with the elastomer core center being about 2 millimeters in diameter. The elastomer core center has an elasticity ratio of 1 to 4, that is, a 10-inch length will be stretchable to 40 inches. This combination of elastic hair tie material and the Elastic Hair Tie Dispenser enables a user to custom cut hair tie material to any desired length for any desired purpose, for any hair type or any application.

The elastomer core center cut to a length of a user desired hair tie, can come in a round or square configuration and stretch four times its original length. The elastomer core center has a cord covering of a pliable nylon yarn material available in many colors. The average thickness of the outer pliable nylon yarn material is 1 millimeter. This outer pliable nylon yarn also has an elasticity ration of 1 to 4.

Figure 3:
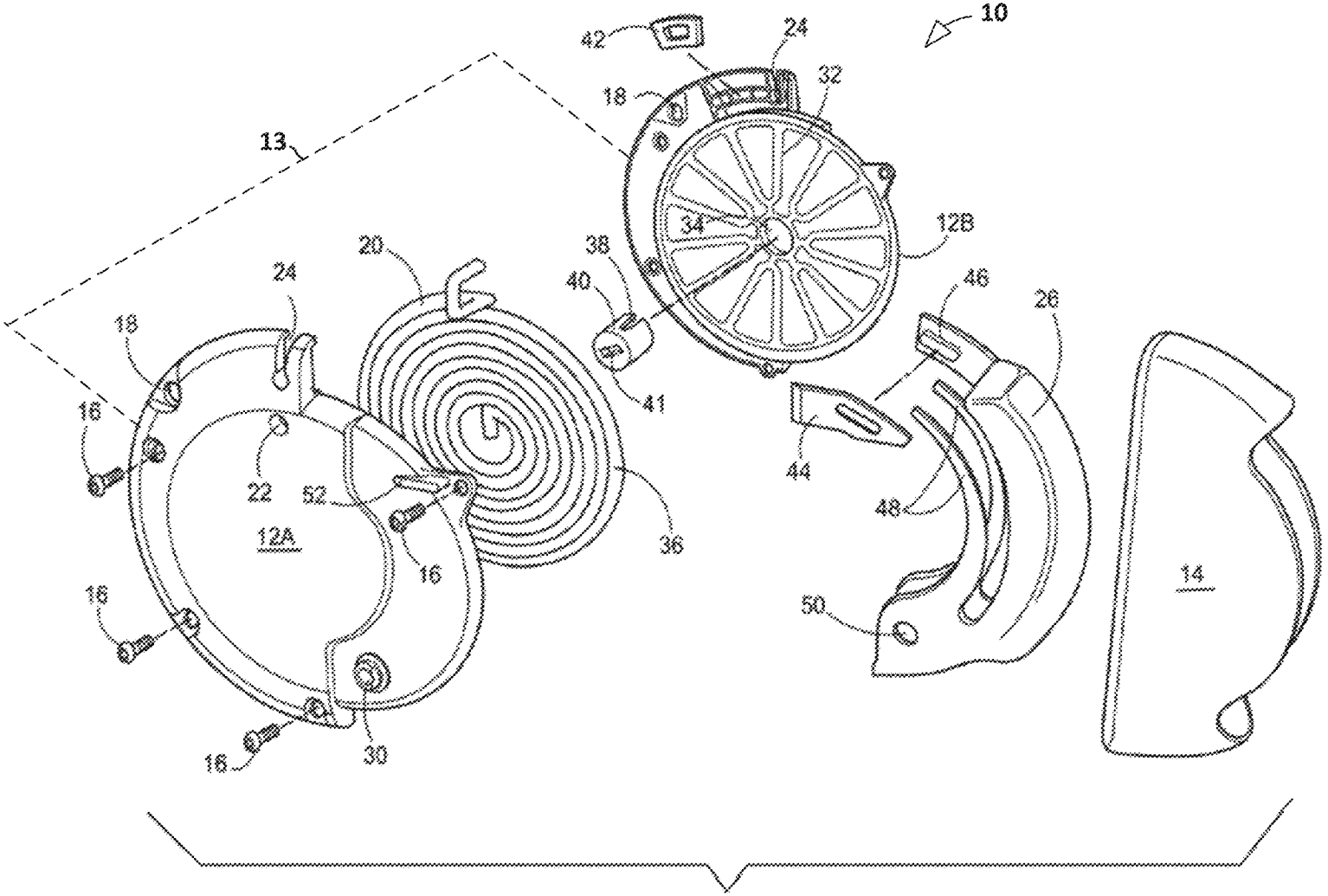
FIG. 3 depicts an exploded perspective view of the Elastic Hair Tie Dispenser.

FIG. 3 depicts an exploded perspective view of the Elastic Hair Tie Dispenser 10 with the left side transparent housing section 12A and the right side transparent housing section 12B to be held together with screws 16 to form dispenser housing 13. Other methods of attaching the left side transparent housing section 12A and the right side transparent housing section 12B may be used as a means to attach them together and will still be covered within the scope of this application.

A lanyard orifice 18, the cording orifice 22 the cutting slot 24 and the boss 30 for the pivoting blade actuator 26 are on the outside surfaces of the transparent sections 12A and 12B. The inside surface of transparent sections 12A and 12B are mirror images with structural ribs 32 and a spool orifice 34 that do not extend to the outside surface.

The replaceable elastic cording within a fabric sleeve 20 is in a coil 36 to be affixed through a cording slot 38 in the spool 40 that is held within the spool orifices 34 on the inside of the transparent sections 12A and 12B. A polyurethane cutting pad 42 is inserted between the left side transparent housing section 12A and the right side transparent housing section 12B and works as a cushion for the cutting blade 44.

A pivoting blade actuator 26 has a cutting blade 44 attachment section 46 and two spring back fingers 48 are a unique means with their flexibility to retract the cutting blade 44 while the unit is pivoting on boss 30 in orifices 50. It is directed in both ways by the means of the finger guides 52 on the outside surfaces of the transparent sections 12A and 12B after pressure has been applied to the blade actuator 26. The flexible safety cover 14 houses the pivoting blade actuator 26.

Figure 4:
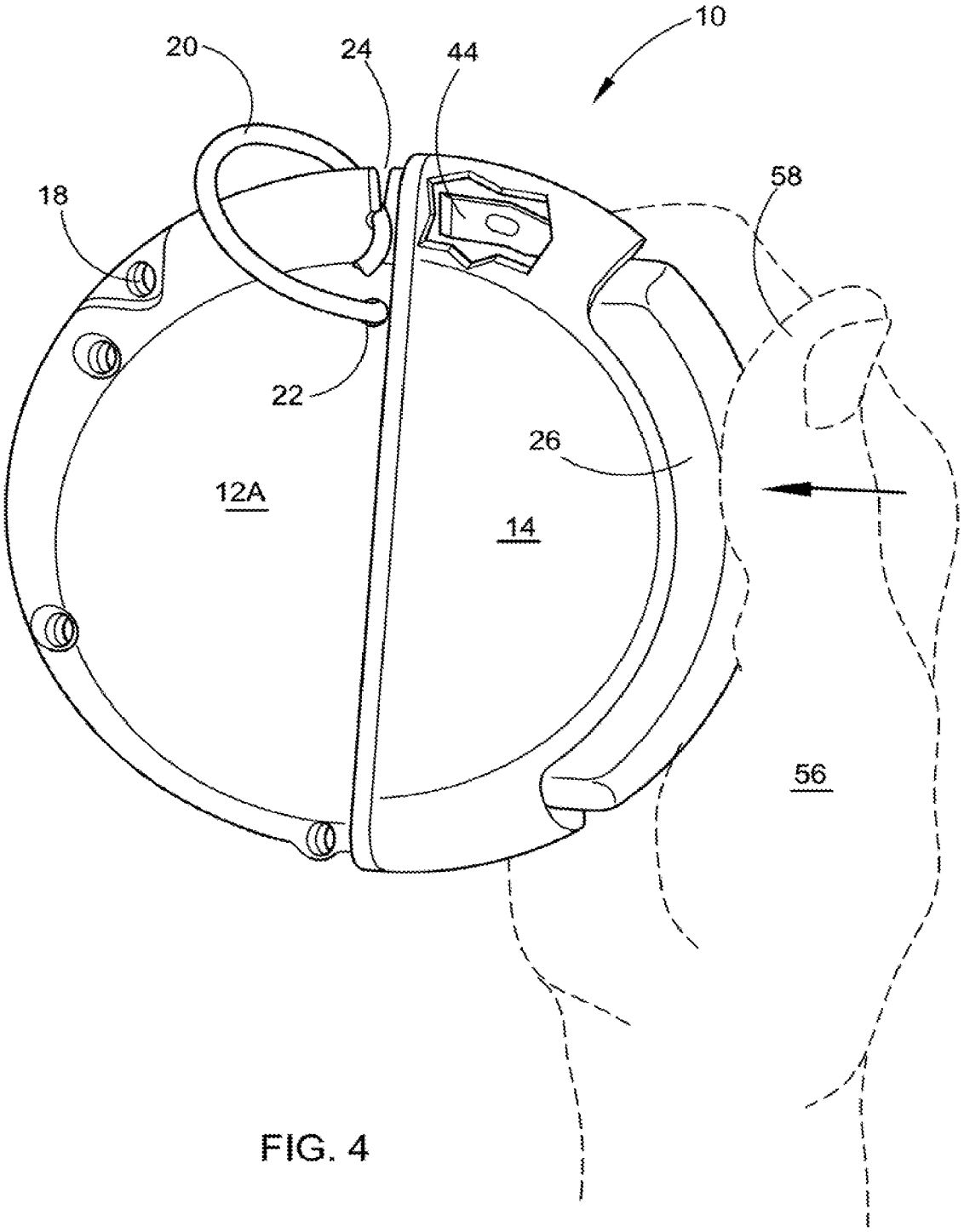
FIG. 4 depicts a perspective view of a hand holding the Elastic Hair Tie Dispenser with a hand holding it and a user pressing with the thumb to actuate the blade to cut the replaceable elastic cording.

FIG. 4 depicts a perspective view of a hand 56 holding the Elastic Hair Tie Dispenser 10 with the thumb 58 pressing the pivoting blade actuator 26 to cut the replaceable elastic cording 20 with the cutting blade 44.

Figure 5:
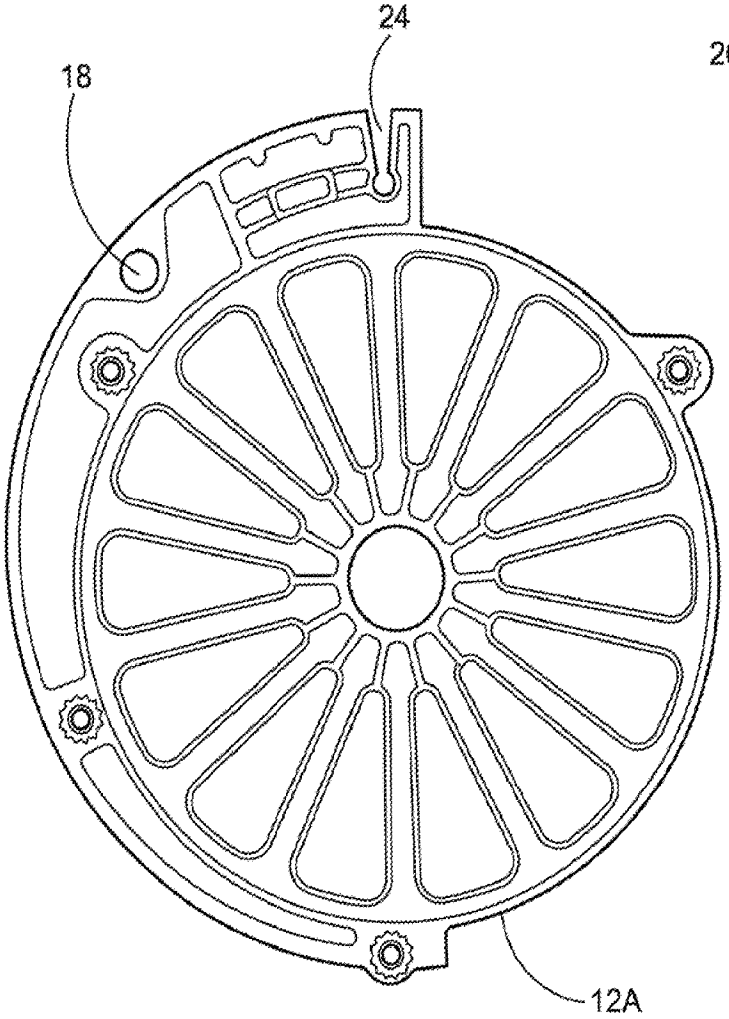
FIG. 5 depicts a left side view of the interior of the transparent section of the Elastic Hair Tie Dispenser.

FIG. 5 depicts an interior of the left side transparent housing section 12A.

Figure 6:
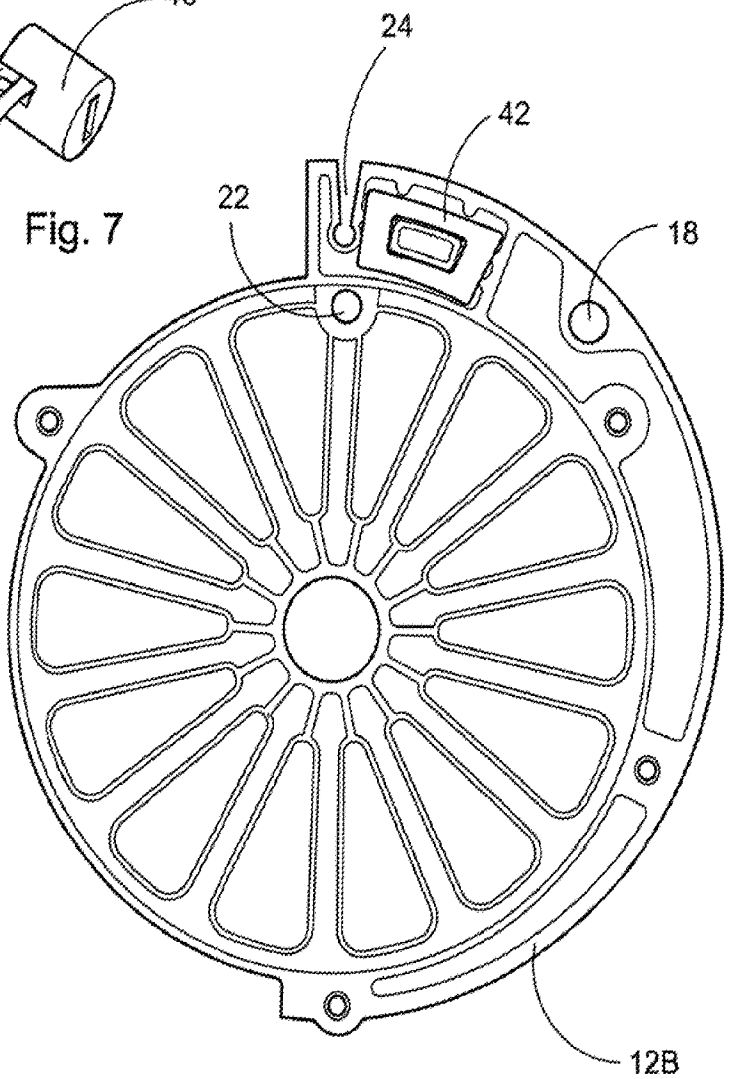
FIG. 6 depicts a right-side view of the interior of the transparent section of the Elastic Hair Tie Dispenser.

FIG. 6 depicts an the interior of the right side transparent housing section 12B.

Figure 7:
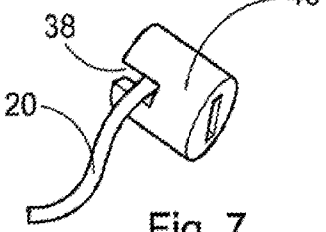
FIG. 7 depicts a perspective view of the spool element.

FIG. 7 depicts a perspective view of the spool 40 with the replaceable elastic cording 20 going through the cording slot 38.

Figure 8:
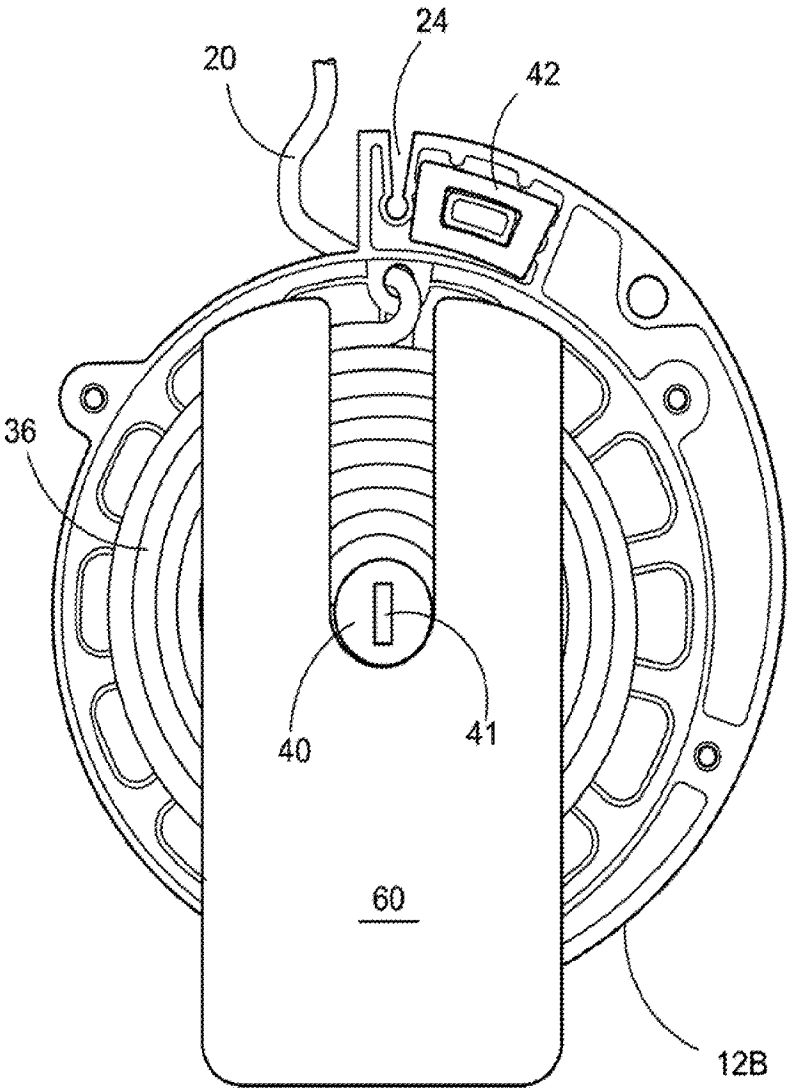
FIG. 8 depicts a side view of the right side of the transparent section of the Elastic Hair Tie with the winding tool for the replaceable elastic cording over the spool.

FIG. 8 depicts right side transparent housing section 12B with the winding tool 60 for the replaceable elastic cording 20 engaging the spool 40. By placing a small flathead screwdriver in the screwdriver slot 41 and rotating it, the replaceable elastic cording 20 is drawn in and formed into the coil 36.

Figure 9:
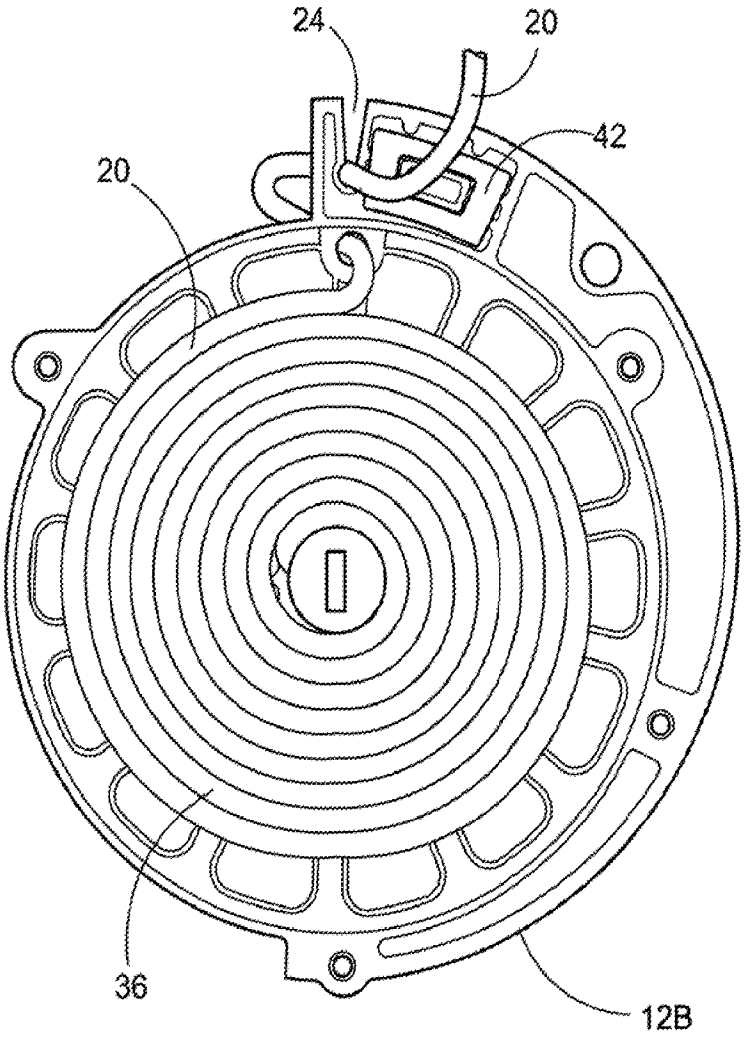
FIG. 9 depicts a side view of the right side of the transparent section of the Elastic Hair Tie with replaceable elastic cording fed through the cutting slot.

FIG. 9 depicts right side transparent housing section 12B with replaceable elastic cording 20 fed through the cutting slot 24.

Figure 10:
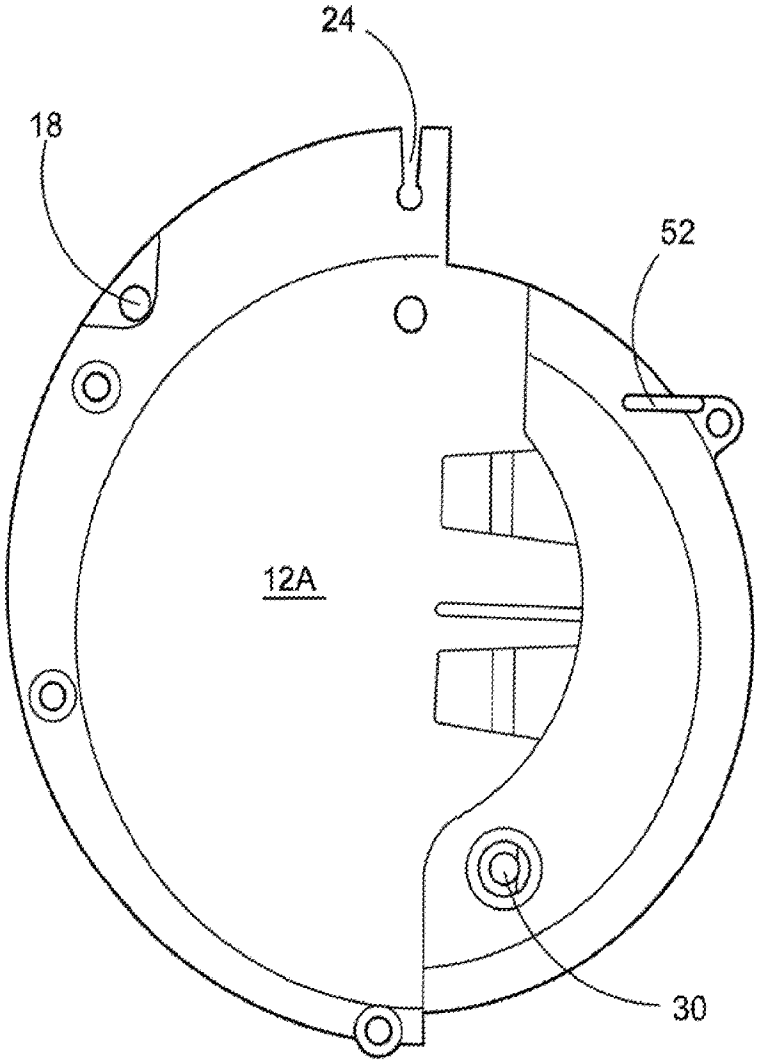
FIG. 10 depicts an exterior side view of the transparent section of the Elastic Hair Tie Dispenser.

FIG. 10 depicts an exterior side of the left side transparent housing section 12A illustrating the location of the finger guide 52 for the spring back fingers 48 on the pivoting blade actuator 26.

Figure 11:
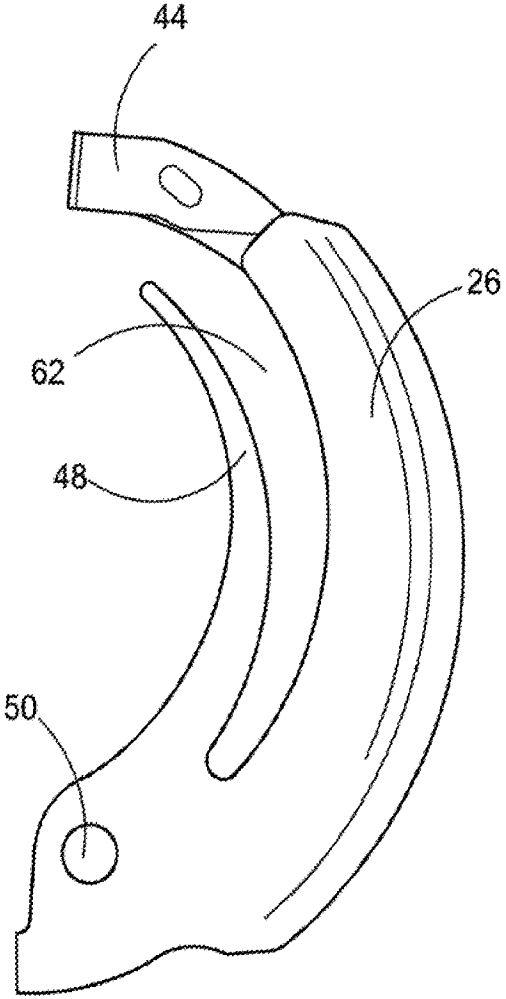
FIG. 11 depicts side view of the pivoting blade actuator of the Elastic Hair Tie Dispenser.

FIG. 11 depicts a side view of the pivoting blade actuator 26 and the cavity 62 where the finger guides 52 translate to give the spring action to pull back the cutting blade 44.

Figure 12:
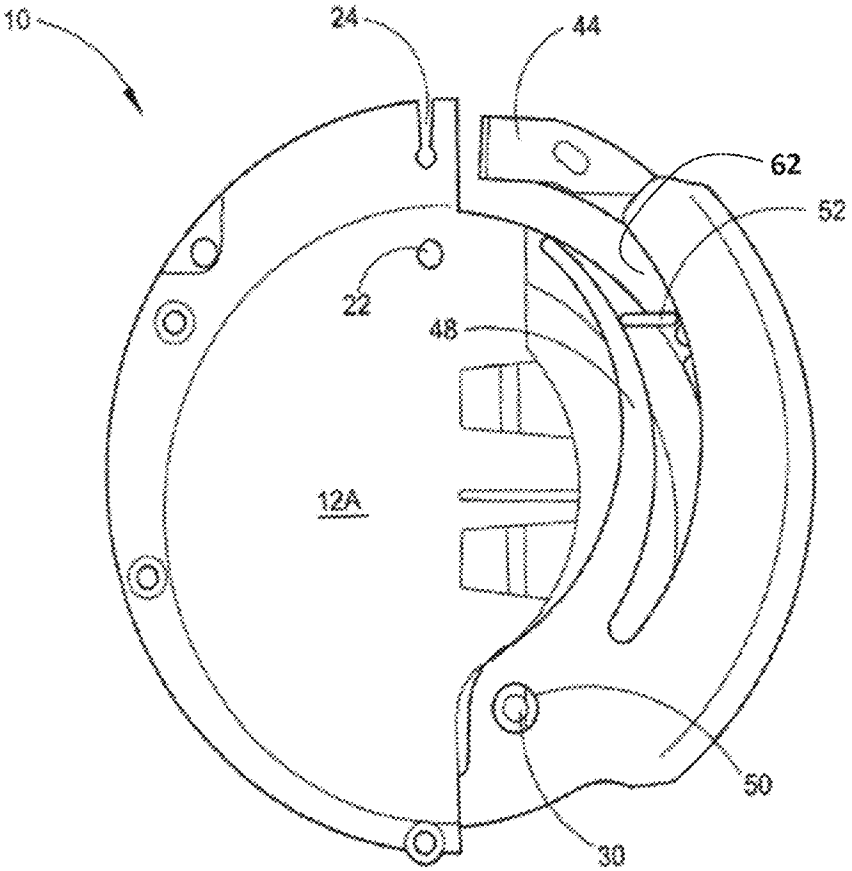
FIG. 12 depicts an assembled view of the pivoting blade actuator located on the transparent section of the Elastic Hair Tie Dispenser.

FIG. 12 depicts an assembled view of the pivoting blade actuator 26 (shown separated from the dispenser unit in FIG. 11) located on the left side transparent housing section 12A of the Elastic Hair Tie Dispenser 10 further clarifying the action and location of the cavity 62 where the finger guides 52 translate to give the spring action to pull back the cutting blade 44.

Figure 13:
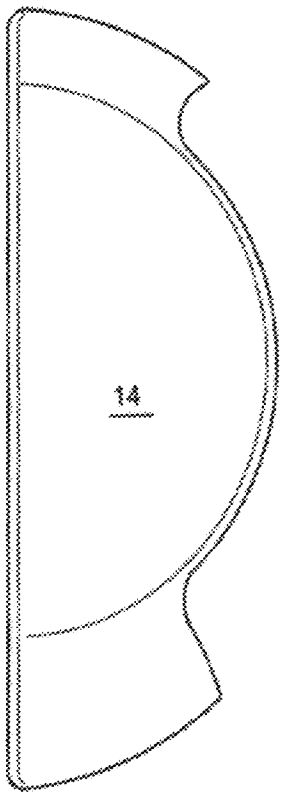
FIG. 13 depicts a side view of the flexible cover of the Elastic Hair Tie Dispenser.

FIG. 13 depicts a side view of the flexible safety cover 14 of the Elastic Hair Tie Dispenser 10.

The Elastic Hair Tie Dispenser 10 shown in the drawings and described in detail herein disclose arrangements of elements of particular construction and configuration for illustrating preferred embodiments of structure and method of operation of the present design. It is to be understood, however, that elements of different construction and configuration and other arrangements thereof, other than those illustrated and described may be employed for providing an Elastic Hair Tie Dispenser 10 in accordance with the spirit of this invention, and such changes, alternations and modifications as would occur to those skilled in the art are considered to be within the scope of this application as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. An elastic hair tie dispenser, comprising:

two round transparent clamshell housing sections, including a first housing section and a second housing section, configured to be held together with fasteners, wherein when assembled the first and second housing sections form a dispenser housing, wherein the dispenser housing is configured to accept a centrally located spool and a cutting blade;

two cutting slot sections, including a first cutting slot section formed in the first housing section and a second cutting slot section formed in the second housing section, wherein the two cutting slot sections form a cutting slot when the first and second housing sections are assembled;

a cording orifice molded into the second housing section directly below the second cutting slot section;

elastic hair tie cording material removably wound around the centrally located spool within the dispenser housing, wherein the elastic hair tie cording material is dispensable, through the cording orifice, to a desired length; and a pivoting blade actuator movably attached to the dispenser housing, wherein the pivoting blade actuator includes a removable replaceable cutting blade, spring back fingers, and an a pivoting orifice for pivotably mounting on the dispenser housing, wherein the cutting blade, responsive to the pivoting blade actuator being forced forward by a user, cuts the elastic hair tie cording material dispensed into any desired length by a user, and springs back to be in position to cut again.

2. The elastic hair tie dispenser according to claim 1, wherein the elastic hair tie cording material includes an elastomer core center which comprises 90% rubber compound and has an elasticity ratio of 4:1.

3. The elastic hair tie dispenser according to claim 2, wherein the elastic hair tie cording material removably wound around the centrally located spool forming a coil within the dispenser housing includes an elastomer core center which comprises 90% rubber compound, 5% color added and 5% solvents and releasing agents used in manufacture, and has an elasticity ratio of 4:1, and further wherein the elastomer core center is covered by fabric of varying colors.

4. The elastic hair tie dispenser according to claim 1, wherein the dispenser housing includes a cutting pad wherein when the cutting blade is actuated using the pivoting blade actuator, the cutting blade moves to cut the hair tie cording material and stops on the cutting pad working as a cushion for the cutting blade.

5. The elastic hair tie dispenser according to claim 1, further including a removeable pivoting blade safety cover wherein the safety cover attaches to the dispenser housing by snapping on to the dispenser housing and prevents the cutting blade from unwanted exposure or actuation cutting motion when attached.

6. The elastic hair tie dispenser according to claim 1, wherein the centrally located spool is rotatably affixed to the dispenser housing and includes a cording slot and a screwdriver slot, wherein the elastic hair tie cording material coiled within the dispenser housing is fastened to the centrally located spool, and a user can coil hair tie material back into the dispenser housing by winding the elastic hair tie cording material using a screwdriver positioned within the screwdriver slot, thereby obtaining any desired length of hair tie material to be cut and subsequently used.

7. The elastic hair tie dispenser according to claim 1, wherein the elastic hair tie cording material is sold separately as an individual coil package and can be inserted into the dispenser housing by disassembling the dispenser housing, thereby refilling the dispenser housing with a coil of elastic hair tie cording material.

8. The elastic hair tie dispenser according to claim 1, wherein the elastic hair tie cording material is sold separately as an individual coil package and can be inserted into the dispenser housing by attaching a length of elastic cording hair tie material to the centrally located spool and winding the elastic hair tie cording material into the dispenser housing and onto the centrally located spool.

9. The elastic hair tie dispenser according to claim 1, wherein the dispenser housing further includes a lanyard orifice for attaching a lanyard.

10. A method for making an elastic hair tie dispenser, comprising the steps of:

providing two round clamshell transparent housing sections, including a first housing section and a second housing section, configured to be held together with fasteners, wherein when assembled the first and second housing sections form a dispenser housing, wherein the dispenser housing is configured to accept a centrally located spool and a cutting blade, wherein a first cutting slot section formed in the first housing section and a second cutting slot section formed in the second housing section form a cutting slot when the first and second housing sections are assembled;

providing elastic hair tie cording material removably wound around the centrally located spool forming a coil within the dispenser housing;

providing a cording orifice molded into the second housing section directly below the second cutting slot section; and providing a pivoting blade actuator, wherein the pivoting blade actuator movably attached to the dispenser housing, includes a removable replaceable cutting blade, spring back fingers and a pivoting orifice for pivotably mounting on the dispenser housing, whereby when in operation, wherein the cutting blade, response to the pivoting blade actuator being forced forward by a user, cuts the elastic hair tie cording material dispensed into any desired length by a user, and springs back to be in position to cut again.

11. The method of making an elastic hair tie dispenser according to claim 10, wherein the dispenser housing further includes a lanyard orifice for attaching a lanyard.

12. The method of making an elastic hair tie dispenser according to claim 10, wherein the elastic hair tie cording material removably wound around the centrally located spool forming a coil within the dispenser housing includes an elastomer core center which comprises 90% rubber compound, 5% color added and 5% solvents and releasing agents used in manufacture, and has an elasticity ratio of 4:1.

13. The method of making an elastic hair tie dispenser according to claim 12, wherein the elastic hair tie cording material removably wound around the centrally located spool forming a coil within the dispenser housing includes an elastomer core center which comprises 90% rubber compound, 5% color added and 5% solvents and releasing agents used in manufacture, and has an elasticity ratio of 4:1, and further wherein the elastomer core center is covered by fabric of varying colors.

14. The method of making an elastic hair tie dispenser according to claim 10, wherein the dispenser housing includes a cutting pad and further wherein when the cutting blade is actuated using the pivoting blade actuator, the cutting blade moves to cut the hair tie cording material and stops on the cutting pad working as a cushion for the cutting blade.

15. The method of making an elastic hair tie dispenser according to claim 10, further including a removeable pivoting blade safety cover wherein the safety cover attaches to the dispenser housing by snapping on to the dispenser housing and prevents the cutting blade from unwanted exposure or actuation cutting motion when attached.

16. The method of making an elastic hair tie dispenser according to claim 10, wherein the centrally located spool is rotatably affixed to the dispenser housing and includes a hair tie material fastening slot and an external slot, wherein the elastic hair tie cording material coiled within the dispenser housing is fastened to the centrally located spool, and a user can coil hair tie material back into the dispenser housing by winding the elastic hair tie cording material using a screwdriver positioned within the external slot, thereby obtaining any desired length of hair tie material to be cut and subsequently used.

17. The method of making an elastic hair tie dispenser according to claim 10, wherein the elastic hair tie cording material is sold separately as an individual coil package and can be inserted into the dispenser housing by disassembling the dispenser housing, thereby refilling the dispenser housing with a coil of elastic hair tie cording material.

18. The method of making an elastic hair tie dispenser according to claim 10, wherein the elastic hair tie cording material is sold separately as an individual coil package and can be inserted into the dispenser housing by attaching a length of elastic cording hair tie material to the centrally located spool and winding the elastic hair tie cording material into the dispenser housing and onto the centrally located spool.

* * * * *